US005482256A

United States Patent [19]

Caron

[11] Patent Number: 5,482,256

[45] Date of Patent: Jan. 9, 1996

[54] SLAT SYSTEM FOR CHAIN LINK FENCE

[76] Inventor: Lévis Caron, 113 Landreville, St-Sulpice, Québec, Canada, J0K 3J0

[21] Appl. No.: 208,597

[22] Filed: Mar. 11, 1994

[51] Int. Cl.[6] ..... B21F 27/00

[52] U.S. Cl. ..... 256/34; 256/22; 256/35

[58] Field of Search ..... 256/34, 24, 32, 256/35, 22, 50, 60; 245/11

[56] References Cited

U.S. PATENT DOCUMENTS

| | | | |
|---|---|---|---|
| 2,760,759 | 8/1956 | Rice | 256/34 |
| 2,802,645 | 8/1957 | Rice | 256/34 |
| 3,037,593 | 6/1962 | Webster | 189/34 |
| 3,069,142 | 12/1962 | Kessler | 256/34 |
| 4,085,954 | 4/1978 | Thompson | 256/34 |
| 4,512,556 | 4/1985 | Meglino | 256/34 |
| 4,723,761 | 2/1988 | Cluff | 256/34 |
| 4,725,044 | 2/1988 | Cluff | 256/34 |
| 4,860,997 | 8/1989 | Schoenheit et al. | 256/34 |
| 4,860,998 | 8/1989 | Snyder | 256/34 |
| 4,995,591 | 2/1991 | Humphrey et al. | 256/34 |
| 5,007,619 | 4/1991 | Sibeni | 256/34 |
| 5,165,664 | 11/1992 | Cluff | 256/34 |
| 5,234,199 | 8/1993 | Cluff | 256/34 |

FOREIGN PATENT DOCUMENTS 1237007 5/1988 Canada .

*Primary Examiner*—Eric K. Nicholson
*Assistant Examiner*—Harry C. Kim

[57] ABSTRACT

A slat system, to be mounted on a chain link fence, comprises an elongate slat-retaining member woven through the links of the chain link fence and a plurality of slats. The slats are also woven through the chain links generally parallel to each other but at a predetermined angle to the elongate slat-retaining member. Each slat has one end formed with an arrow-shaped extension to be inserted in a longitudinal groove made in the center of a V-shaped wall of the slat-retaining member. The arrow-shaped extensions of the slats and the slotted wall of the slat-retaining member interlock each other to grip the slats and the slat-retaining member to each other and thereby prevent the slats from moving longitudinally on the chain link fence.

7 Claims, 2 Drawing Sheets

SLAT SYSTEM FOR CHAIN LINK FENCE

BACKGROUND OF THE INVENTION

1. Field of the Invention

The present invention relates to a slat system designed to facilitate installation thereof on a chain link fence.

2. Brief Description of the Prior Art

The slat system of U.S. Pat. No. 4,085,954 granted to Thompson on Apr. 25, 1978 comprises a plurality of generally parallel slats woven through the links of a chain link fence. The lower ends of the slats are placed in an elongate channel-shaped slat-retaining member also woven through the links at an angle to the slats. The upper ends of the slats preferably engage another channel-shaped slat-retaining member or another slat further woven through the links parallel to the lower channel-shaped slat-retaining member.

A disadvantage of the slat system of Thompson is that it requires a retainer member at both ends of the slats to lock and prevent longitudinal movement of these slats on the chain link fence.

U.S. Pat. No. 4,512,556 (Meglino) issued on Apr. 23, 1985 discloses a slat system comprising a plurality of parallel slats woven through the links of a chain link fence. An aperture is formed in each slat and an elongate connecting member is simultaneously woven through the links of the chain link fence and inserted in the above mentioned apertures to lock the parallel slats in position on the fence.

As can be appreciated by those of ordinary skill in the art, a drawback of the slat system of Meglino is that the steps of weaving first the slats through the links of the chain link fence and thereafter simultaneously weaving the connecting member through the fence links and inserting it through the apertures of the slats requires skill and are tedious and time-consuming.

OBJECT OF THE INVENTION

An object of the present invention is to overcome the above discussed drawbacks of the prior art by providing an easy-to-install slat system in which the parallel slats are fastened and locked to a single slat-retaining member.

SUMMARY OF THE INVENTION

More specifically, in accordance with the present invention, there is provided a slat system to be mounted on a chain link fence, comprising:

an elongate slat-retaining member to be mounted on the chain link fence;

a plurality of slats to be woven through the links of the chain link fence generally parallel to each other but at a predetermined angle to the elongate slat-retaining member, these slats comprising respective first ends;

first and second mutually interlocking connective means located on the first end of each slat and on the slat-retaining member, respectively, the first and second connective means comprising gripping elements for mutually interlocking these connective means and for thereby fastening the first ends of the slats to the slat-retaining member and prevent said slats from moving longitudinally on the chain link fence.

The gripping elements can be designed to enable interlocking of the first and second connective means by weaving each slat through the fence links and then simply pushing this slat longitudinally toward the slat-retaining member already installed on the fence, thus facilitating installation of the slat system.

In accordance with preferred embodiments of the invention:

the predetermined angle is 90°;

the elongate slat-retaining member is woven through the links of the chain link fence at that predetermined angle to the slats;

the second connective means comprises a longitudinal slot in the elongate slat-retaining member, and the first connective means comprises a barbed extension of the first end of each slat, this barbed extension being inserted in the longitudinal slot to fasten the first end of each slat to the slat-retaining member;

each slat comprises two opposite sides, and the extension comprises on each side of the slat a plurality of transversely distributed barbs;

the barbed extension has an arrow-shaped cross section; and the longitudinal slot is made in a surface of the slat-retaining member which is both concave and substantially V-shaped in cross section.

The objects, advantages and other features of the present invention will become more apparent upon reading of the following non restrictive description of a preferred embodiment thereof, given by way of example only with reference to the accompanying drawings.

DETAILED DESCRIPTION OF THE PREFERRED EMBODIMENT

Figure 1:
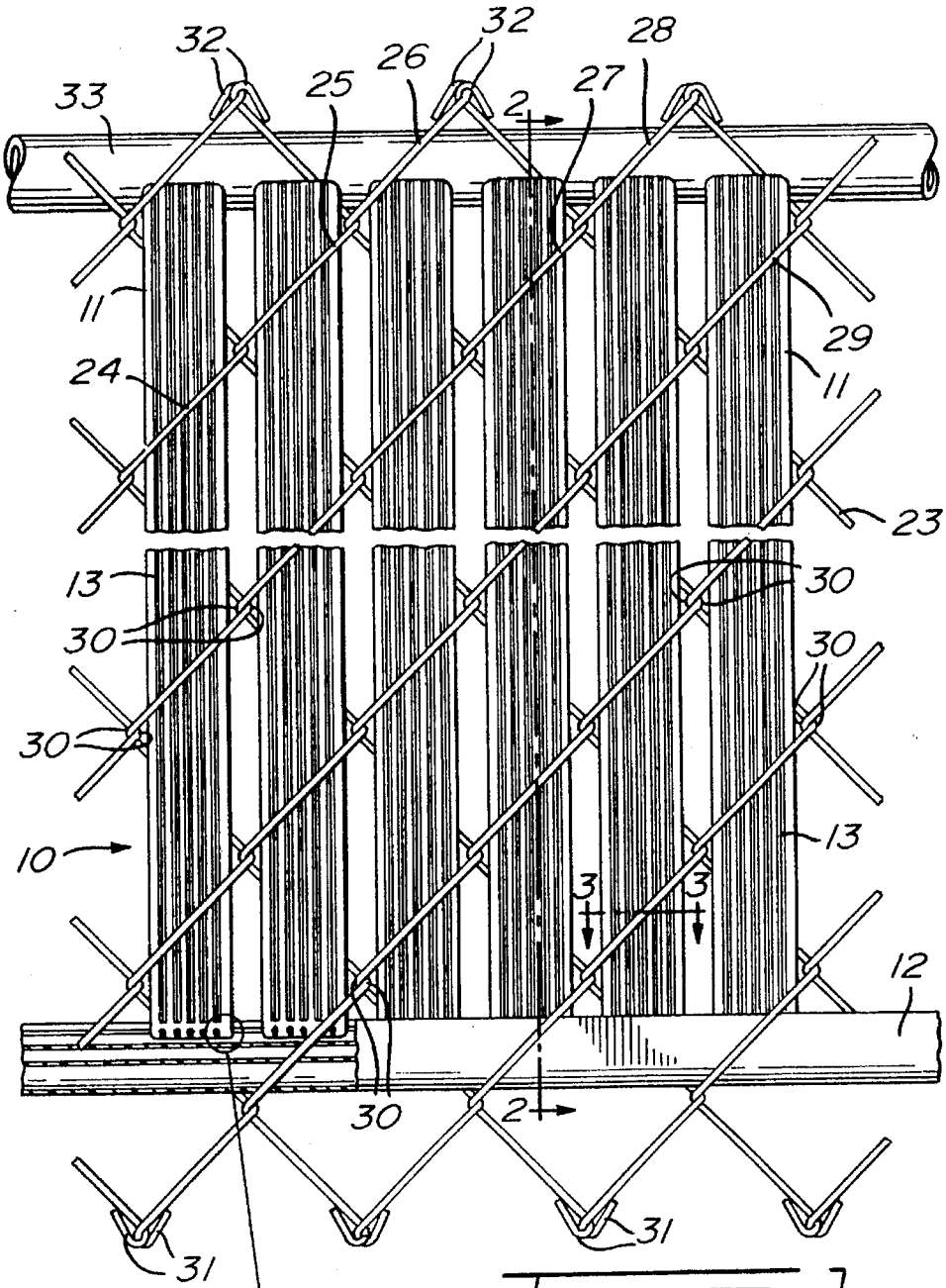
FIG. 1 is a front elevational view of a slat system in accordance with the present invention, woven through the links of a chain link fence.
Figure 1A:
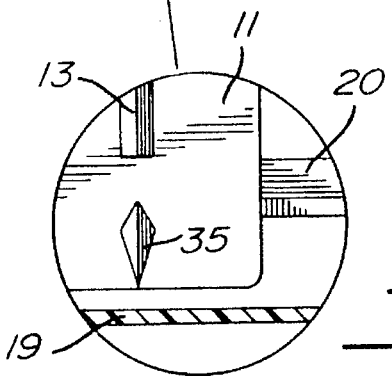
FIG. 1*a* is an enlarged view of a portion of the slat system of FIG. 1.
Figure 2:
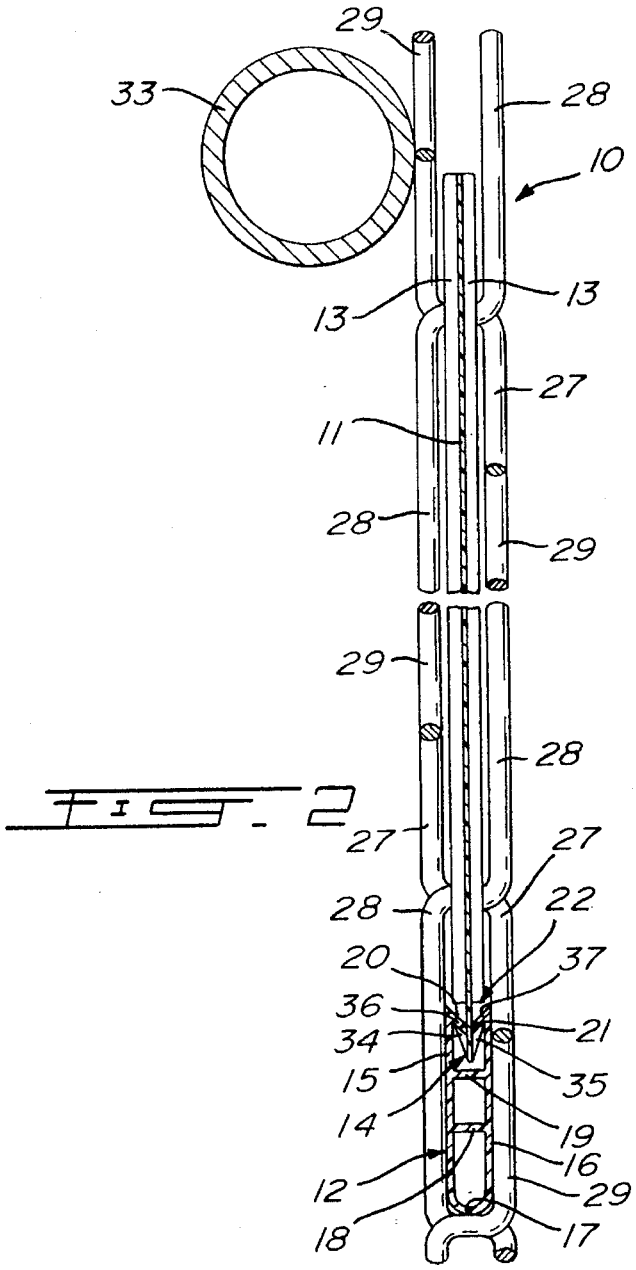
FIG. 2 is a side elevational, cross sectional view of the slat system taken along line 2—2 of FIG. 1.
Figure 3:
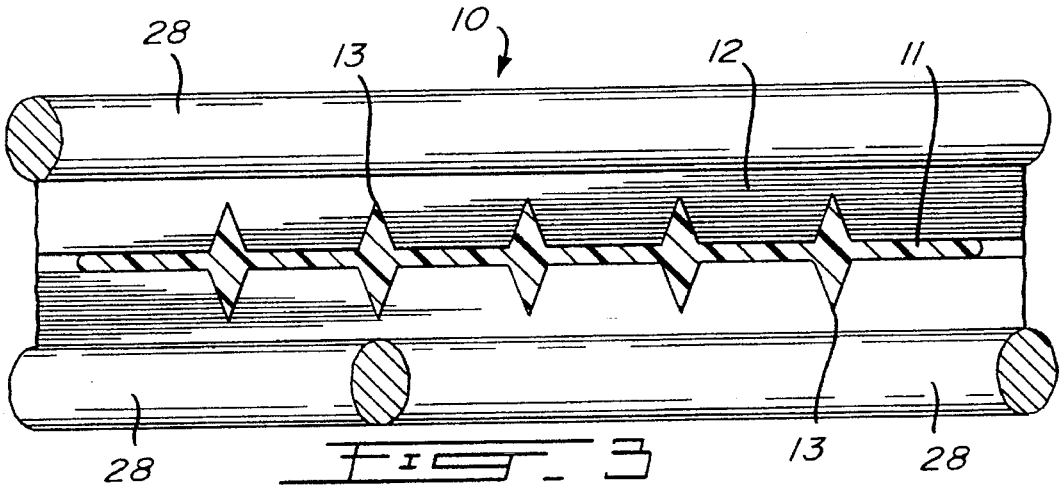
FIG. 3 is a cross sectional, top plan view of the slat system taken along line 3—3 of FIG. 1.

The slat system in accordance with the present invention is generally identified by the reference 10 in FIGS. 1, 2 and 3 of the appended drawings.

The slat system 10 is fabricated from only two extrusions, one to form elongate slats 11 and the other to form an elongate slat-retaining member 12. Although other materials can be contemplated, these two extrusions are advantageously made of plastic material or synthetic resin.

As illustrated, each slat 11 is flat and formed on both sides thereof with a plurality of longitudinal and parallel protrusions such as 13 having a triangular cross section (FIG. 3). At the lower end of each slat 11, the protrusions 13 are grooved transversely on the two sides of the slat to form an arrow-shaped extension 14 (FIG. 2) of the slat's lower end.

The extrusion forming the elongate slat-retaining member 12 comprises first and second longitudinal and vertical side walls 15 and 16, and to interconnect these two side walls 15 and 16 (a) a lower longitudinal, transversal wall 17, (b) two intermediate longitudinal, transversal flat walls 18 and 19, and (c) an upper longitudinal, transversal wall 20. While lower wall 17 is convex and rounded in cross section for aesthetic purposes, the upper wall 20 is concave, V-shaped in cross section and formed with a central longitudinal slot 21 therein to receive, as will be described hereinafter, the arrow-shaped extensions 14 of the slats' lower ends.

As illustrated in FIG. 1, a chain link fence such as 23 conventionally comprises metallic wires such as 24–29, covered or not with plastic material. The wires 24–29 each extend generally vertically in zig-zag manner and are interlocked one with another to form a plurality of flexible links such as 30. In the illustrated fence 23, the lower ends of adjacent wires 24–29 are interconnected by bending end portions such as 31 thereof on each other. In the same manner, the upper ends of adjacent wires 24–29 are interconnected by bending end portions such as 32 thereof on each other. The fence is mounted on generally vertical metallic tubular posts (not shown) driven into the soil and on upper generally horizontal metallic tube members such as 33 interconnecting each pair of successive posts. This type of fence construction is well known to those of ordinary skill in the art and accordingly will not be further described in the present specification.

To install the slat system 10 on the chain link fence 23, the elongate slat-retaining member 12 is first woven through the links of the fence 23, horizontally in the illustrated example. Of course, it is within the scope of the present invention to mount the slat-retaining member 12 at an angle to the horizontal. It is further within the scope of the present invention to fasten the slat-retaining member 12 to the fence 23 in another manner, for example by fastening the two ends of member 12 to two successive posts (not shown). It is however important to install the slat-retaining member 12 so as to allow insertion of the arrow-shaped extensions 14, woven in the chain link fence 23, in the longitudinal slot 21.

Following installation of the slat-retaining member 12, the slats 11 are successively woven downwardly through the links 30 of the chain link fence 23 from the top of the fence until the lower arrow-shaped extension 14 reaches the longitudinal slot 21. Then, one has simply to push the slat 11 downwardly to insert the point of the arrow-shaped extension 14 through longitudinal slot 21. The material forming the slat-retaining member 12 should be at least slightly flexible to enable spreading apart of the walls 15 and 16 at the level of the V-shaped wall 20 to thereby widen the slot 21 and enable full insertion of the arrow-shaped extension 14 through the slot 21 of the slat-retaining member 12.

The arrow-shaped extension 14 and the slotted V-shaped wall 20 therefore constitute first and second connective means comprising gripping elements for mutually interlocking the said first and second connective means. The gripping elements include the sharp rear barbs 34 and 35 of the point of the arrow-shaped extension 14 and the two halves 36 and 37 of the V-shaped wall 20 on each side of the longitudinal slot 21. Of course, a barb 34 or 35 is formed by each transversely grooved longitudinal protrusion 13 whereby each slat 11 comprises on one side a plurality of transversely distributed barbs 34 and on the other side a plurality of transversely distributed barbs 35. The gripping elements will fasten the lower end of the slats to the slat-retaining member to form connection 22 preventing the slats from moving longitudinally on the chain link fence 23.

In FIG. 1, the slat-retaining member 12 is woven horizontally through the links 30 at the bottom of the chain link fence 23 while the slats 11 are woven vertically with their lower ends connected to the slat-retaining member 12. The slats 11 are therefore arranged at an angle of 90° to the slat-retaining member 12. However, it should be pointed out that any other possible configurations and any other possible angular relationship between the slats 11 and member 12 are within the scope of the subject invention.

Although the present invention has been described hereinabove by way of a preferred embodiment thereof, this embodiment can be modified at will, within the scope of the appended claims, without departing from the spirit and nature of the present invention.

What is claimed is:

1. A slat system to be mounted on a chain link fence formed with a plurality of links, comprising:

an elongate slat-retaining member to be mounted on the chain link fence;

a plurality of solid, substantially flat slats to be woven through the links of the chain link fence generally parallel to each other but at a predetermined angle to the elongate slat-retaining member, each of said slats comprising a flat body with two opposite sides having longitudinal protrusions and a first end;

first and second mutually interlocking connective means located on the first end of each said slat and on the elongate slat-retaining member, respectively, wherein said second connective means comprises a longitudinal slot formed on the elongate slat-retaining member, and wherein said fleet connective means comprises transverse grooves formed on the longitudinal protrusions at the first end of each said slat to form at least one gripping element locking in the longitudinal slot of the elongate slat-retaining member for thereby fastening the first ends of the slats to the elongate slat-retaining member and prevent said slats from moving longitudinally on the chain link fence.

2. A slat system as recited in claim 1, wherein said predetermined angle is 90°.

3. A slat system as recited in claim 1, wherein said elongate slat-retaining member is woven through the links of the chain link fence at said predetermined angle to the slats.

4. A slat system to be mounted on a chain link fence formed with a plurality of links, comprising:

an elongate slat-retaining member to be mounted on the chain link fence;

a plurality of solid, substantially flat slats to be woven through the links of the chain link fence generally parallel to each other but at a predetermined angle to the elongate slat-retaining member, each said slat comprising an elongate flat body with two opposite sides, longitudinal protrusion on said two opposite sides of the elongate flat body, and a first end;

first and second mutually interlocking connective means located on the first end of each said slat and on the elongate slat-retaining member, respectively, wherein said second connective means comprises a longitudinal slot formed on the elongate slat-retaining member, and wherein said first connective means comprises transverse grooves formed on said longitudinal protrusions at the first end of each said slat to form gripping elements locking in the longitudinal slot of the elongate slat-retaining member for thereby fastening the first ends of the slabs to the elongate slat-retaining member and prevent said slate from moving longitudinally on the chain link fence.

5. A slat system as recited in claim 4, wherein said gripping elements comprise on each of said two opposite sides of the elongate flat body a plurality of transversely distributed barbs.

6. A slat system as recited in claim 5, wherein said barbs have an arrow-shaped cross section.

7. A slat system as recited in claim 6, wherein said longitudinal slot is made in a wall of said slat-retaining member which is substantially V-shaped in cross section.

* * * * *